US005588417A

United States Patent [19]

Kotwicki et al.

[11] Patent Number: 5,588,417

[45] Date of Patent: Dec. 31, 1996

[54] ENGINE AIR/FUEL CONTROL WITH EXHAUST GAS OXYGEN SENSOR HEATER CONTROL

[75] Inventors: Allan J. Kotwicki, Dearborn; Jeffrey A. Doering, Southfield; Michael P. Falandino, Wyandotte, all of Mich.

[73] Assignee: Ford Motor Company, Dearborn, Mich.

[21] Appl. No.: 552,047

[22] Filed: Nov. 2, 1995

Related U.S. Application Data

[63] Continuation of Ser. No. 267,735, Jun. 29, 1994.

[51] Int. Cl.[6] ..... F02P 15/08

[52] U.S. Cl. ..... 123/697

[58] Field of Search ..... 123/697, 690, 123/688, 686, 479; 60/274

[56] References Cited

U.S. PATENT DOCUMENTS

| | | | |
|---|---|---|---|
| 3,973,527 | 8/1976 | Nilsson et al. | 123/697 |
| 4,109,615 | 8/1978 | Asano | 123/697 |
| 4,120,269 | 10/1978 | Fujishiro | 123/697 |
| 4,132,200 | 1/1979 | Asano et al. | 123/697 |
| 4,170,965 | 10/1979 | Aono | 123/697 |
| 4,187,806 | 2/1980 | Schnurle et al. | 123/697 |
| 4,889,098 | 12/1989 | Suzuki et al. | 123/697 |
| 4,993,392 | 2/1991 | Tanaka et al. | 123/697 |
| 5,067,465 | 11/1991 | Yamasaki et al. | 123/697 |
| 5,111,792 | 5/1992 | Nagai et al. | 123/697 |
| 5,148,795 | 9/1992 | Nagai et al. | 123/697 |
| 5,170,769 | 12/1992 | Berger et al. | 123/688 |
| 5,245,979 | 9/1993 | Pursifull et al. | 123/690 |
| 5,285,762 | 2/1994 | Werner et al. | 123/690 |
| 5,353,775 | 10/1994 | Yamashita et al. | 123/686 |

OTHER PUBLICATIONS

Bosch Technical Bulletin 6(1978)3 entitled "Regulation Of The Mixture Composition for Injection OHO Engines By Means Of LAMDBA Sensor".

*Primary Examiner*—Raymond A. Nelli
*Attorney, Agent, or Firm*—Allan J. Lippa

[57] ABSTRACT

An engine air/fuel control system responsive to an electrically heated exhaust gas oxygen sensor. Electrical power is supplied to the sensor by a feedback control system responsive to peak-to-peak measurement in the sensor output. Peak-to-peak measurements are averaged over a predetermined number of sample times and the resulting average value compared to a deadband. When the average measurement is above, within, or below the deadband, electrical power to the heater is, respectively, reduced, held constant, or decreased.

16 Claims, 8 Drawing Sheets

ENGINE AIR/FUEL CONTROL WITH EXHAUST GAS OXYGEN SENSOR HEATER CONTROL

This is a continuation of copending application Ser. No. 08/267,735 filed Jun. 29, 1994.

BACKGROUND OF THE INVENTION

The field of the invention relates to control systems for controlling engine air/fuel operation in response to exhaust gas oxygen sensors.

It is well-known to trim liquid fuel delivered to the engine in response to an exhaust gas oxygen sensor output to maintain a stoichiometric air/fuel ratio. Typically, the exhaust gas oxygen sensor is continuously heated to maintain operating temperature and, accordingly, a stable peak-to-peak excursion in the sensor output.

To conserve electrical power, approaches have been developed to infer the temperature of the exhaust gas oxygen sensor from engine operating conditions such as throttle position, inducted airflow, and engine speed. Electrical energy is supplied to, or decoupled from, the heater or in response to these engine measurements in an attempt to maintain constant temperature while conserving electrical power.

The inventors herein have recognized a number of problems with the above approach. For example, inferring sensor temperature from engine operating conditions may not be perfectly correlated with actual sensor temperature for all operating conditions, all vehicles, all powertrain combinations, and all exhaust gas oxygen sensors. Further, initial correlations may drift as engines, engine components, and sensors age.

SUMMARY OF THE INVENTION

An object of the invention herein is to maintain a desired peak-to-peak excursion in an exhaust gas oxygen sensor output by electrically heating the sensor in response to a measurement of the peak-to-peak output.

The above object is achieved, and problems of prior approaches overcome, by providing an engine air/fuel control method and control system responsive to an exhaust gas oxygen sensor and controlling an electric heater coupled to the sensor. In one particular aspect of the invention, the method comprises the steps of: generating an indicating signal from a measurement of peak-to-peak excursion in the sensor output; controlling electrical energy supplied to the electric heater in response to the indicating signal; and adjusting fuel delivered to the engine in response to a feedback variable derived from the sensor output.

An advantage of the above aspect of the invention is that desired peak-to-peak sensor output is maintained by feedback control of electric power supplied to the sensor in response to peak-to-peak measurement. The prior problems of maintaining heater temperature in response to an inference of heater temperature are thereby avoided. For example, the sensor output is advantageously maintained in a desired range regardless of engine operating conditions, type of vehicle or powertrains employed, or aging of components.

BRIEF DESCRIPTION OF THE DRAWINGS

The above object, and advantages of the invention claimed herein and others, will be more clearly understood by reading an example of an embodiment in which the invention is used to advantage with reference to the attached drawings wherein:

DESCRIPTION OF AN EMBODIMENT

Figure 1:
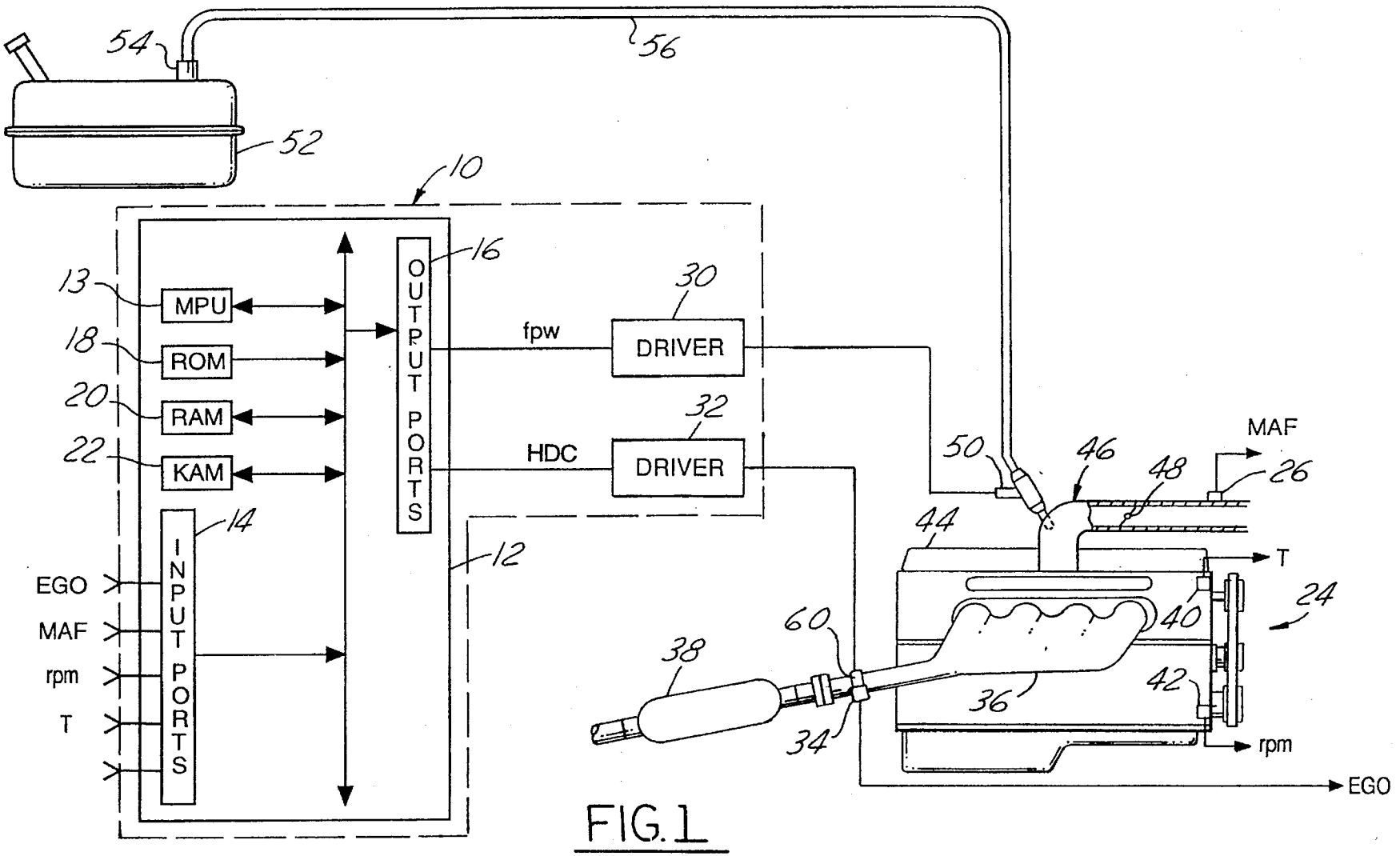
FIG. 1 is a block diagram of an embodiment in which the invention is used to advantage.

Engine controller 10 is shown in the block diagram of FIG. 1 including conventional microcomputer 12 having: microprocessor unit 13; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing learned values; and a conventional data bus. Conventional electronic drivers 30 and 32 are also shown.

In this particular example, exhaust gas oxygen (EGO) sensor 34 is shown coupled to exhaust manifold 36 of engine 24 upstream of conventional catalytic converter 38. Tachometer 42 and temperature sensor 40 are each shown coupled to engine 24 for providing, respectively, signal rpm related to engine speed and signal T related to engine coolant temperature to controller 10.

Intake manifold 44 of engine 24 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Signal fpw is amplified by driver 30 of controller 10 in a conventional manner. Fuel is delivered to fuel injector 50 by a conventional fuel system including fuel tank 52, fuel pump 54, and fuel rail 56.

Electric heater 60 is shown thermally coupled to EGO sensor 34 for supplying heat to EGO sensor 34 in relation to the duty cycle of signal HDC from controller 10 as described in more detail later herein. Signal HDC is amplified in a conventional manner by driver 32 of controller 10.

Other conventional engine components and systems which are well-known to those skilled in the art are not shown for clarity. For example, engine 24 includes a conventional ignition system having a distributor and coil coupled to spark plugs. Conventional exhaust gas recirculation and fuel vapor recovery systems are also included but not shown.

Figure 2:
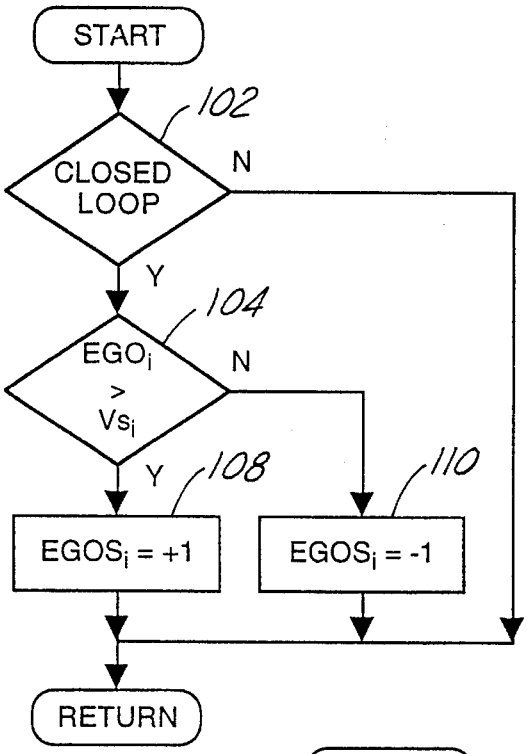
FIGS. 2–5 are high level flowcharts illustrating various steps performed by a portion of the embodiment illustrated in FIG. 1.

Referring now to FIG. 2, two-state signal EGOS is generated by comparing signal EGO from sensor 34 to adaptively learned reference value Vs. More specifically, when various operating conditions of engine 24, such as temperature (T), exceed preselected values, closed-loop air/fuel feedback control is commenced (step 102). Each sample period of controller 10, the output of sensor 34 is sampled to generate signal $EGO_i$. Each sample period (i) when signal $EGO_i$ is greater than adaptively learned reference or set voltage $Vs_i$ (step 104), signal $EGOS_i$ is set equal to a positive value such as unity (step 108). On the other hand, when signal $EGO_i$ is less than reference value $Vs_i$ (step 104) during sample time (i), signal $EGOS_i$ is set equal to a negative value such as minus one (step 110). Accordingly, two-state signal EGOS is generated with a positive value indicating exhaust gases are rich of a desired air/fuel ratio such as stoichiometry, and a negative value when exhaust gases are lean of the desired air/fuel ratio. In response to signal EGOS, feedback variable FFV is generated as described later herein with particular reference to FIG. 4 for adjusting the engine's air/fuel ratio.

Figures 3, 4:
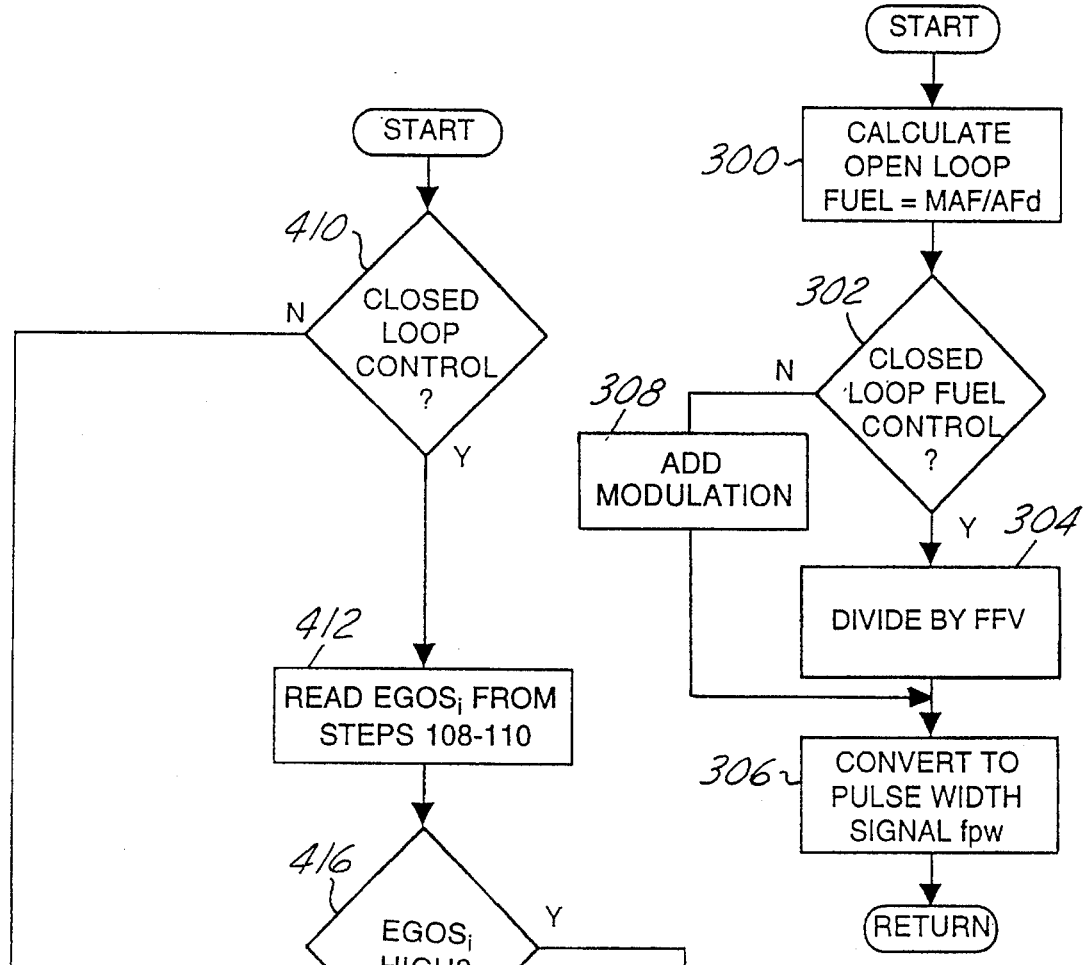

A flowchart of the liquid fuel delivery routine executed by controller 10 for controlling engine 24 is now described beginning with reference to the flowchart shown in FIG. 3. An open loop calculation of desired liquid fuel is first calculated in step 300. More specifically, the measurement of inducted mass airflow (MAF) from sensor 26 is divided by a desired air/fuel ratio (AFd). After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306) via injector driver 60 (FIG. 1).

As described in greater detail later herein with particular reference to FIG. 9, desired fuel signal fd is modulated (step 308) by a periodic signal during an initialization period. Any periodic signal may be used such as a triangular wave, sine wave, or square wave. This initialization period precedes and is preparatory to closed loop feedback control.

The air/fuel feedback routine executed by controller 10 to generate fuel feedback variable FFV is now described with reference to the flowchart shown in FIG. 4. After closed control is commenced (step 410), signal $EGOS_i$ is read during sample time (i) from the routine previously described with respect to steps 108–110. When signal $EGOS_i$ is low (step 416), but was high during the previous sample time or background loop (i −1) of controller 10 (step 418), preselected proportional term Pj is subtracted from feedback variable FFV (step 420). When signal $EGOS_i$ is low (step 416), and was also low during the previous sample time (step 418), preselected integral term Δj is subtracted from feedback variable FFV (step 422).

Similarly, when signal EGOS is high (step 416), and was also high during the previous sample time (step 424), integral term Δi is added to feedback variable FFV (step 426). When signal EGOS is high (step 416), but was low during the previous sample time (step 424), proportional term Pi is added to feedback variable FFV (step 428).

Adaptively learning set or reference Vs is now described with reference to the subroutine shown in FIG. 5. For illustrative purposes, reference is also made to the hypothetical operation shown by the waveforms presented in FIGS. 6A and 6B. In general, adaptively learned reference Vs is determined from the midpoint between high voltage signal Vh and low voltage signal V1. Signals Vh and V1 are related to the high and low values of signal EGO during each of its cycles with the addition of several features which enables accurate adaptive learning under conditions when signal EGO may become temporarily pegged at a rich value, or a lean value, or shifted from its previous value.

Figure 5:
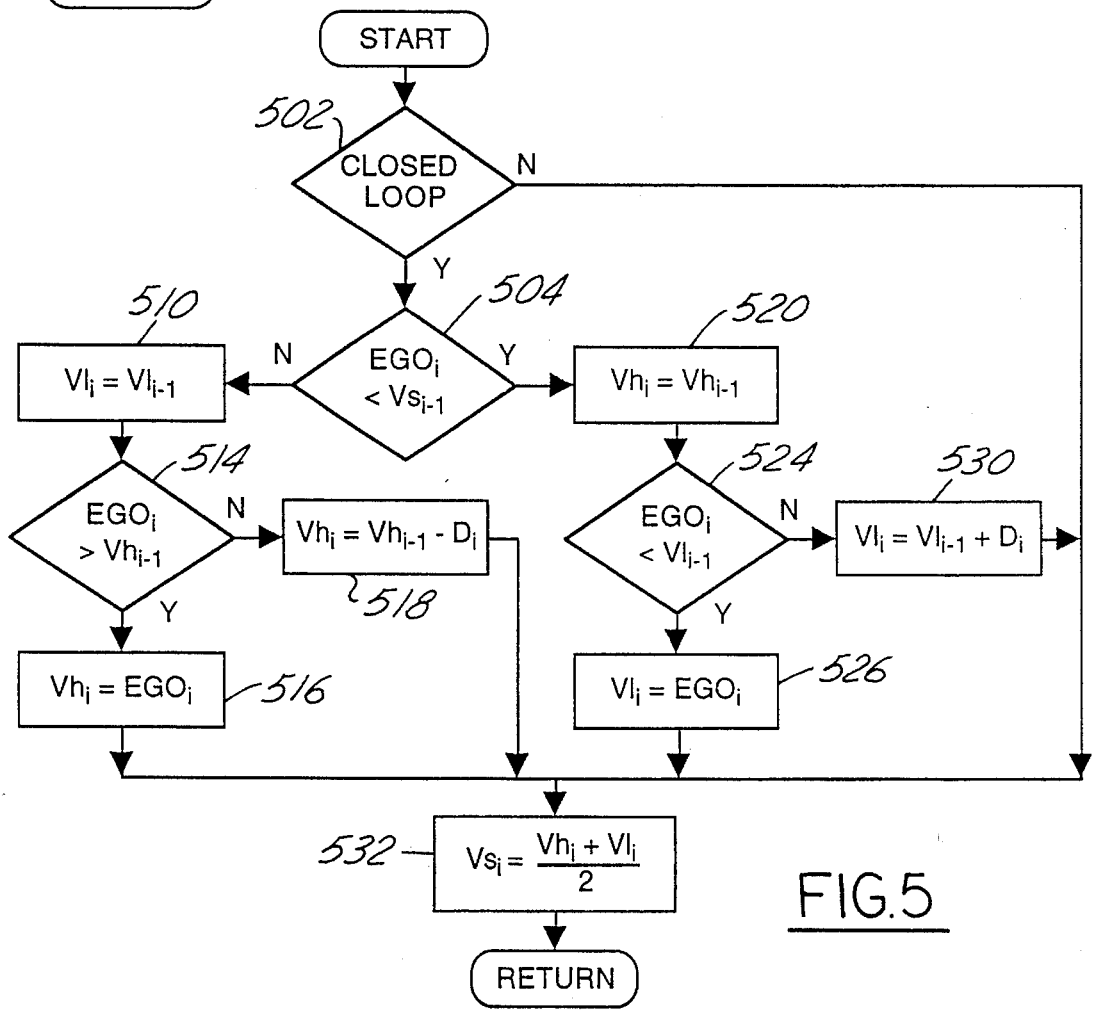

Referring first to FIG. 5, after closed loop air/fuel control is commenced (step 502), signal $EGO_i$ for this sample period (i) is compared to reference $Vs_{i-1}$ which was stored from the previous sample period (i −1) in step 504. When signal $EGO_i$ is greater than previously sampled signal $Vs_{i-1}$, the previously sampled low voltage signal $V1_{i-1}$ is stored as low voltage signal $V1_i$ for this sample period (i) in step 510. This operation is shown by the graphical representation of signal V1 before time t2 shown in FIG. 6A. Returning to FIG. 5, when signal $EGO_i$ is greater than previously sampled high voltage signal $Vh_{i-1}$ (step 514), signal $EGO_i$ is stored as high voltage signal $Vh_i$ for this sample period (i) in step 516. This operation is shown in the hypothetical example of FIG. 6A between times t1 and t2.

Figure 6A:
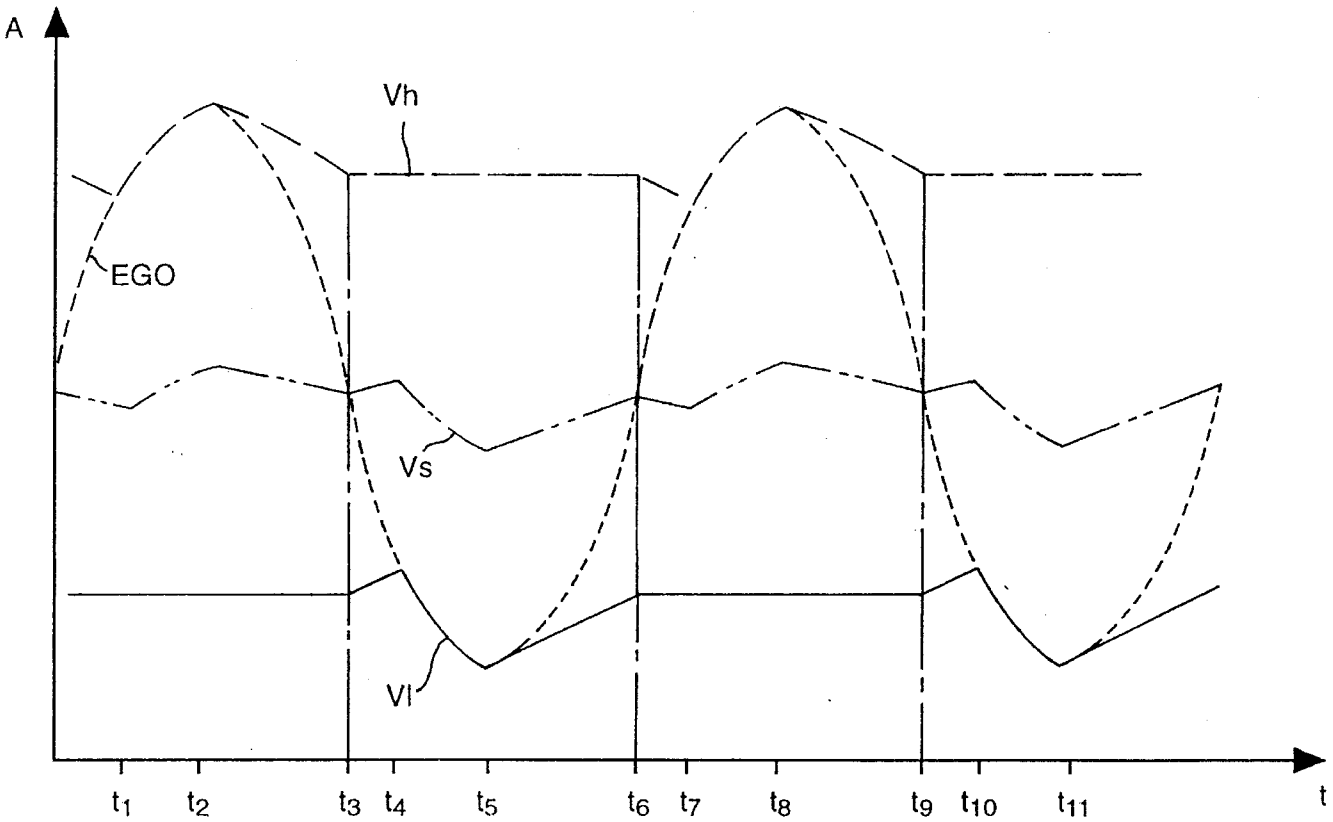
FIGS. 6A, 6B, 7, and 8 illustrate various outputs associated with a portion of the embodiment illustrated in FIG. 1 and explained with reference to the flowcharts shown in FIGS. 25.

When signal $EGO_i$ is less than previously stored high voltage signal $Vh_{1-1}$ (step 514), but greater than signal $VS_{1-1}$, high voltage signal $Vh_i$ is set equal to previously sampled high voltage $Vh_{i-1}$ less predetermined amount $D_i$ which is a value corresponding to desired signal decay (step 518). This operation is shown in the hypothetical example presented in FIG. 6A between times t2 and t3. As shown in FIG. 6A, high voltage signal Vh decays until signal $EGO_i$ falls to a value less than reference Vs at which time high voltage signal Vh is held constant. Although linear decay is shown in this example, nonlinear decay and experiential decay may be used to advantage. Referring to the corresponding operation shown in FIG. 5, high voltage signal $Vh_i$ is stored as previously sampled high voltage signal $Vh_{i-1}$ (step 520) when signal $EGO_i$ is less than previously sampled reference $Vs_{i-1}$ (step 504).

Continuing with FIG. 5, when signal $EGO_i$ is less than both previously sampled reference $Vs_{i-1}$ and previously sampled low voltage signal $V1_{i-1}$ (step 524) signal $EGO_{i-1}$ is stored as low voltage signal $V1_i$ (step 526). An example of this operation is presented in FIG. 6A between times t4 and t5.

When signal $EGO_i$ is less than previously sampled reference $Vs_{i-1}$ (step 504), but greater than previously sampled high voltage signal $V1_{i-1}$ (step 524), high voltage signal $V1_i$ is set equal to previously sampled high voltage signal $V1_{i-1}$ plus predetermined decay value $D_i$ (step 530). The decay applied in step 530 may be different from that applied in step 518. An example of this operation is shown graphically in FIG. 6A between times t5 and t6.

As shown in step 532 of FIG. 5, reference $Vs_i$ is calculated each sample period (i) by interpolating between high voltage signal $Vh_i$ and low voltage signal $V1_i$ each sample time (i) represented by Vs=(∂Vh1+(1−d) Vli) /2. In this particular example, a midpoint calculation is used to advantage.

Figure 6B:
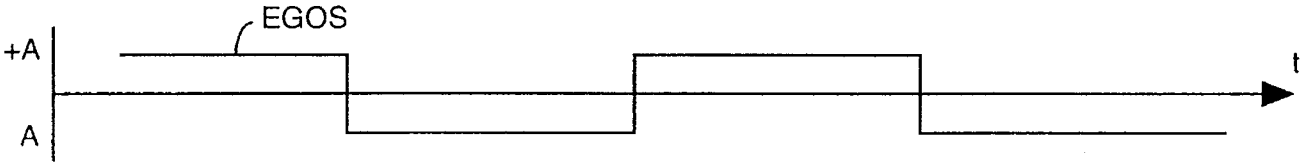

Referring to the hypothetical example presented in FIGS. 6A and 6B, signal EGOS is set at a high output amplitude (+A) when signal EGO is greater than reference Vs and set at a low value (−A) when signal EGO is less than reference Vs.

In accordance with the above described operation, reference Vs is adaptively learned each sample period so that signal EGOS is accurately determined regardless of any shifts in the output of signal EGO. In addition, advantageous features such as allowing high voltage signal Vh and low voltage signal V1 to decay only to values determined by the zero crossing point of signal EGO, prevent the reference from becoming temporarily pegged when air/fuel operation runs rich or lean for prolonged periods of time. Such operation may occur during either wide-open throttle conditions or deceleration conditions.

Figure 7:
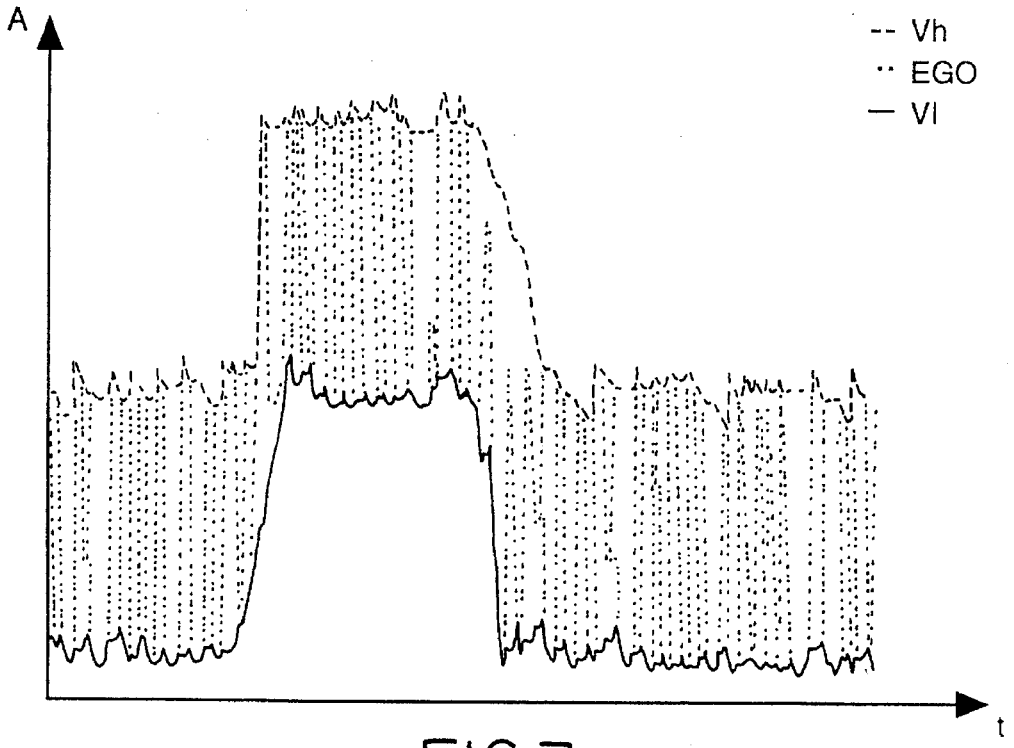
Figure 8:
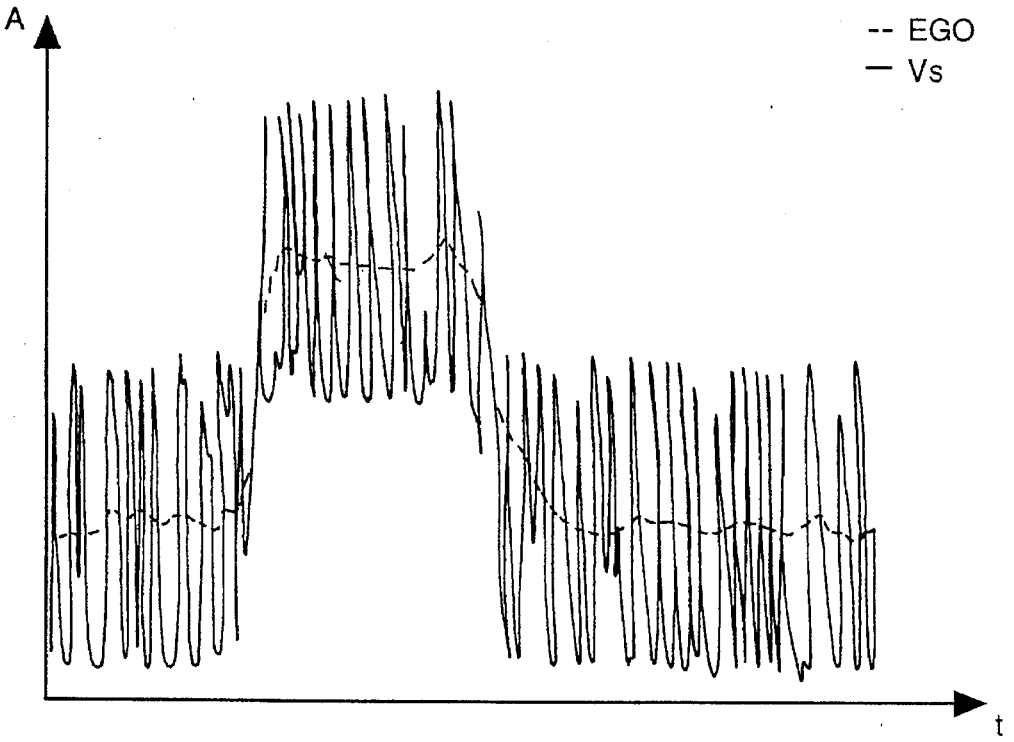

Advantages of the above described method for adaptively learning reference Vs are shown in FIGS. 7 and 8 during conditions where signal EGO incurs a sudden shift. More specifically, FIG. 7 shows a hypothetical operation wherein high voltage signal Vh and low voltage signal V1 accurately track the outer envelope of signal EGO and the resulting reference is shown accurately and continuously tracking the midpoint in peak-to-peak excursions of signal EGO in FIG. 8.

An initialization period having an adaptively learned period or time duration which precedes closed loop fuel control is now described with reference to the flowchart shown in FIG. 9 and related waveforms shown in FIGS. 10 and 11. In general, during the initialization period, open loop fuel control is modulated by superimposing a periodic signal on the desired fuel charge signal. When a form of the modulation is detected in the output of EGO sensor 34, an indication is provided that EGO sensor 34 has achieved proper operation and, accordingly, closed loop fuel control commences. Those skilled in the art will recognize that although sensor 34 is shown in this example as a conventional two-state exhaust gas oxygen sensor, the invention described herein is applicable to other types of exhaust gas oxygen sensors such as proportional sensors and is also applicable to other types of exhaust sensors such as HC and $NO_x$ sensors.

Figure 9:
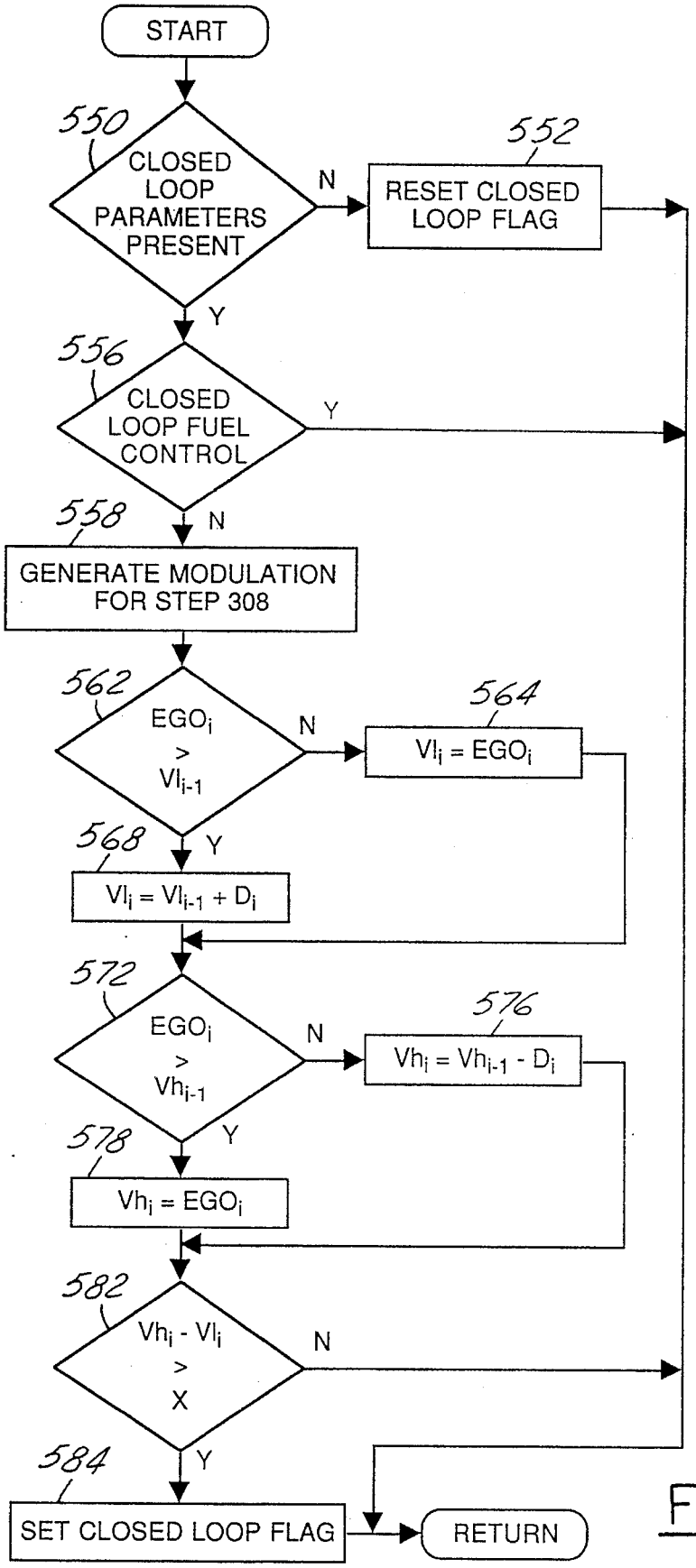
FIG. 9 is a high level flowchart illustrating various steps performed by a portion of the embodiment illustrated in FIG. 1.

First referring to FIG. 9, engine operating parameters associated with closed loop fuel control are first sampled during step 550. In this example, these parameters include engine temperature T being beyond a preselected temperature. When the closed loop parameters are absent, the closed loop flag is reset in step 552 thereby disabling closed loop fuel control. On the other hand, when the closed loop parameters are present, the initializing subroutine is entered provided that engine 24 is not presently operating in closed loop fuel control (step 556).

Upon entering the initialization period, a modulation signal having a periodic cycle such as a triangular or sinusoidal wave is first generated during step 558. As previously described herein with particular reference to FIG. 3, the modulating signal modulates the desired fuel quantity delivered to engine 24.

Continuing with FIG. 9, when signal $EGO_i$ for this sample period (i) is less than low voltage signal $Vl_{i-1}$ stored from the previous sample period (i −1), low voltage signal $V1_i$ is set equal to signal $EGO_i$ (step 564). On the other hand, when signal $EGO_i$ is greater than previously stored signal $V1_{i-1}$ (step 562), signal $V1_i$ for this sample period is set equal to previously stored signal $Vl_{i-1}$ plus predetermined value $D_i$ (step 568). In this particular example, predetermined value $D_i$ is added when required each sample time to generate a predetermined rate which is applied to increase or decrease the signals described herein.

When signal $EGO_i$ is less than previously stored high voltage signal $Vh_{i-1}$ as shown in step 572, then signal $Vh_i$ decays at a predetermined rate as provided by predetermined value $D_i$. More specifically, as shown in step 576, signal $Vh_i$ is set equal to previously stored signal $Vh_{i-1}$ less predetermined value $D_i$. However, when signal $EGO_i$ is greater than signal $Vh_{i-1}$ (step 572), signal $Vh_i$ is set equal to signal $EGO_i$ for this sample period (i) as shown in step 578.

The difference between signal $Vh_i$ and signal $V1_i$ is then compared to preselected value x during step 582. When this difference exceeds preselected value x, it is apparent that a sufficient portion of the input modulation is observed at the output of EGO sensor 34 such that closed loop fuel control should commence. Accordingly, the closed loop fuel flag is set in step 584.

Figure 10:
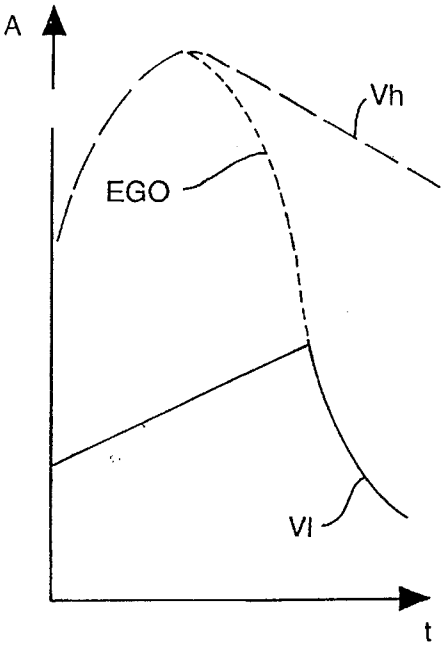
FIGS. 10–11 illustrate various outputs associated with a portion of the embodiment illustrated in FIG. 1 and explained herein with particular reference to FIG. 9.

For illustrative purposes, a hypothetical example is illustrated by the waveforms in FIG. 10. More specifically, a hypothetical signal EGO is shown and the associated high voltage signal Vh and low voltage signal V1 are illustrated by the waveforms shown in FIG. 10. For the particular example, there is a sufficient difference between signal Vh and signal V1 to terminate the initialization period and actuate closed loop feedback control.

Figure 11:
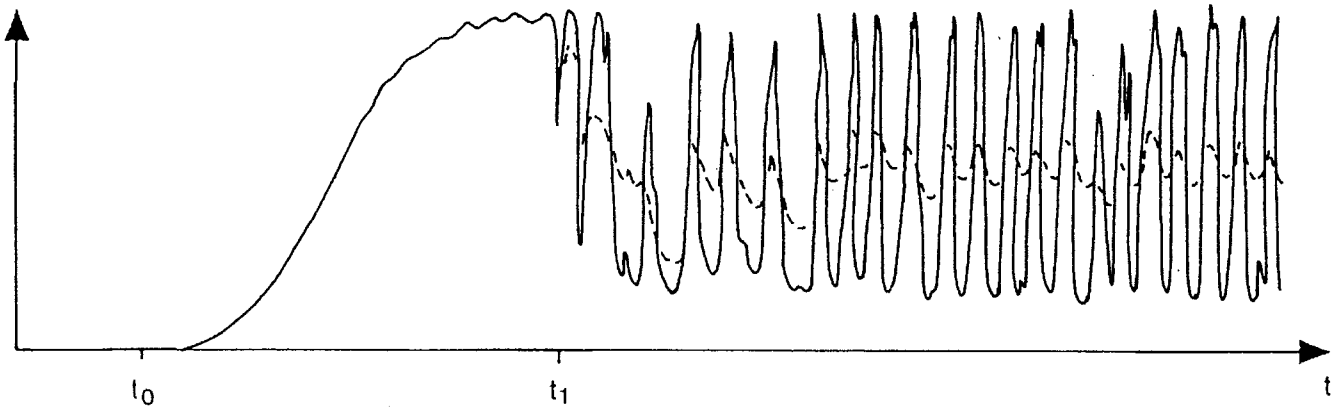

Another hypothetical operation is illustrated in FIG. 11. In this particular example, the initialization period occurs between times $t_0$ and $t_1$. At time t1, the above described input modulation is detected in signal EGO, the initialization period then terminated, and feedback control commenced.

Figure 12:
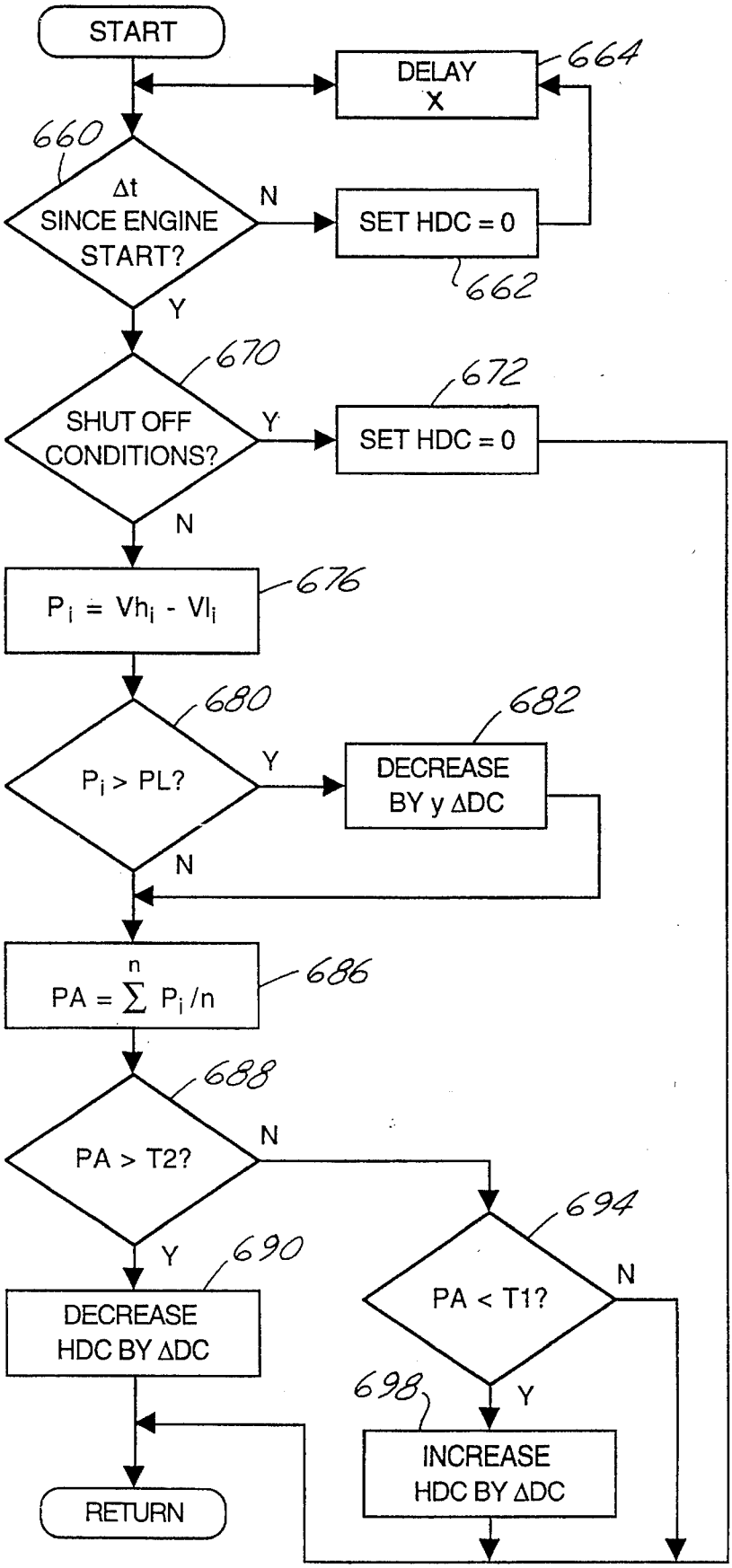
FIG. 12 is a high level flowchart illustrating various steps performed by a portion of the embodiment illustrated in FIG. 1.

Referring now to FIG. 12, the subroutine for supplying electrical energy to electrical heater 60 is now described. Steps 660, 662, and 664 provide delay time Δt commencing from an initial condition such as engine start. More specifically, if the time since engine start is less than Δt (step 660), heater duty cycle signal HDC is set equal to zero (step 662). A time delay "x" is then induced before returning to the subroutine (step 664).

Alternative delay mechanisms may also be employed to initiate heater control after the engine exhaust appears to have heated EGO sensor 34 beyond the exhaust gas dew point. For example, coolant temperature may be used to advantage. When the engine has been operating for at least time Δt (step 662), heater shut-off conditions are monitored during step 670. In this particular example conditions such as wide-open throttle are monitored. Additional shut-off conditions indicative of decreased amplitude in the output of EGO sensor 34 are also monitored such as long-cruise conditions. These heater shut-off conditions are advantageously provided in a table (not shown). Heater power is shut-off by setting duty cycle signal HDC equal to zero (step 672).

When heater shut-off conditions are not present (step 670), the peak-to-peak amplitude of signal EGO for sample period (i) is determined by subtracting low voltage signal $V1_i$ from high voltage signal $Vh_i$ for sample period (i) during step 676. If peak-to-peak signal $P_i$ exceeds limit value PL (step 680), heater duty cycle is decreased by multiple "y" times duty cycle increment ΔDC (step 682).

During step 686, peak-to-peak signal $P_i$ is averaged over "n" sample periods. In this particular example, five sample periods were chosen. The resulting average peak signal PA is then compared to threshold value T2 (step 688) which defines the upper boundary of a deadband. If average signal PA is greater than signal T2 (step 688), heater duty cycle HDC is decreased a predetermined amount shown as ΔDC in this particular example (step 690).

When average signal PA is less than value T2, average signal PA is checked to see if it is less than the lower limit T1 of the deadband during step 694. If average signal PA is within the deadband, that is greater than low limit T1 but less than upper limit T2 (steps 688 and 694), then signal HDC is not altered. However, if signal PA is less than lower limit T1 of the deadband (step 694), signal HDC is increased by a predetermined amount such as ΔDC (step 698).

In accordance with the above description, feedback control of the EGO sensor heater is advantageously employed to maintain average, peak-to-peak sensor output within a desired range.

Although one example of an embodiment which practices the invention has been described herein, there are numerous other examples which could also be described. For example, the invention may be used to advantage with proportional exhaust gas oxygen sensors. Further, other combinations of analog devices and discrete ICs may be used to advantage to generate the current flow in the sensor electrode. Another form of control which may be used is to supply electrical energy to heater 60 for a minimum duration whenever average peak amplitude of the EGO sensor falls below a predetermined value. The invention is therefore to be defined only in accordance with the following claims.

What is claimed:

1. A method for controlling engine air/fuel ratio in response to a two-state output of an exhaust gas oxygen sensor and controlling an electric heater coupled to the sensor, comprising the steps of:

measuring peak-to-peak excursion in the two-state sensor output, said measurement occurring continuously while the electric heater is being controlled;

controlling electrical energy supplied to the electric heater in response to said indicating signal to maintain said peak-to-peak excursion within a desired range; and adjusting fuel delivered to the engine in response to a feedback variable derived from the two-state sensor output.

2. The method recited in claim 1 wherein said controlling step decreases said electrical energy by a predetermined amount when said indicating signal exceeds a predetermined value.

3. The method recited in claim 1 wherein said controlling step increases said electrical power by a preselected amount when said indicating signal is less than a preselected value.

4. The method recited in claim 1 wherein said controlling step supplies said electrical power at a selectable duty cycle and said duty cycle is decreased by a predetermined amount each sample time when said indicating signal is greater than a predetermined value and said duty cycle is increased by a preselected amount each sample time when said indicating signal is less than a preselected value.

5. The method recited in claim 1 wherein said adjusting step is activated when said peak-to-peak measurement exceeds a selectable value.

6. The method recited in claim 1 wherein said step of generating said indicating signal comprises a step of averaging a predetermined number of said peak-to-peak measurements.

7. The method recited in claim 1 further comprising a step of decreasing said electrical power when an indication of selected engine operating conditions exceeds a given value.

8. The method recited in claim 1 further comprising a step of generating a midpoint of said peak-to-peak sensor output and wherein said adjusting step generates said feedback variable in response to a comparison of said peak-to-peak sensor output to said midpoint.

9. The method recited in claim 8 wherein said adjusting step integrates said comparison to generate said feedback variable.

10. The method recited in claim 1 wherein said adjusting step comprises a step of dividing an indication of inducted airflow by a predetermined air/fuel ratio and multiplying by said feedback variable.

11. A method for controlling engine air/fuel ratio in response to an exhaust gas oxygen sensor output and controlling an electric heater coupled to the sensor, comprising the steps of:

generating a first signal from a maximum excursion in a first direction of the sensor output and generating a second signal from a maximum excursion in a second direction of the sensor output;

providing an indicating signal from an average of a difference between said first and said second signals;

controlling electrical energy supplied to the electric heater by decreasing said electrical energy by a predetermined amount when said indicating signal exceeds a predetermined value and increasing said electrical power by a preselected amount when said indicating signal is less than a preselected value to maintain said difference between said first and said second signals within a desired range; and adjusting fuel delivered to the engine in response to a feedback variable derived from the sensor output.

12. The method recited in claim 11 wherein said first signal generating step further includes the steps of storing said sensor output as said first signal when said sensor output is greater than a previously stored first signal and holding said first signal when said sensor output is less than a previously stored reference signal and decreasing said first signal at a predetermined rate when said sensor output is greater than said previously stored reference signal but less than said previously stored first signal.

13. The method recited in claim 12 wherein said second signal generating step further comprises the steps of storing said sensor output as said second signal when said sensor output is less than a previously stored second signal and holding said second signal when said sensor output is greater than a previously stored reference signal and increasing said second signal at a predetermined rate when said sensor output is less than said previously stored reference signal but greater than said previously stored second signal.

14. An air/fuel control system for controlling engine air/fuel ratio in response to and exhaust gas oxygen sensor, comprising:

an electric heater thermally coupled to the sensor;

generating means for generating a first signal from a maximum excursion in a first direction of the sensor output and generating a second signal from a maximum excursion in a second direction of the sensor output;

indicating means for providing an indicating signal from an average of a difference between said first and said second signals;

a controller supplying electrical energy to the sensor, said controller decreasing said electrical energy by a predetermined amount when said indicating signal exceeds a predetermined value and increasing said electrical power by a preselected amount when said indicating signal is less than a preselected value to maintain said difference between said first and said second signals within a desire range; and feedback control means for trimming fuel delivered to the engine in response to a feedback variable derived from a comparison of the sensor output to a reference value generated at a midpoint between said first and said second signals.

15. The control system recited in claim 14 wherein said indicating means computes said difference at preselected time intervals and provides said indicating signal by averaging a predetermined number of said difference computations.

16. The control system recited in claim 14 wherein said controller supplies said electrical power at a selectable duty cycle and said duty cycle is decreased by a predetermined amount each sample time when said indicating signal is greater than a predetermined value and said duty cycle is increased by a preselected amount each sample time said indicating signal is less than a preselected value.

* * * * *